US011679431B1

(12) United States Patent
Gambino

(10) Patent No.: US 11,679,431 B1
(45) Date of Patent: Jun. 20, 2023

(54) PRESSURE DIE SYSTEMS FOR TUBE BENDING MACHINES

(71) Applicant: Joseph Gambino, Sandy, OR (US)

(72) Inventor: Joseph Gambino, Sandy, OR (US)

(73) Assignee: Rogue Fabrication, LLC, Sandy, OR (US)

( * ) Notice: Subject to any disclaimer, the term of this patent is extended or adjusted under 35 U.S.C. 154(b) by 0 days.

(21) Appl. No.: 17/541,101

(22) Filed: Dec. 2, 2021

(51) Int. Cl.
*B21D 7/02* (2006.01)
*B21D 7/024* (2006.01)

(52) U.S. Cl.
CPC ..... *B21D 7/024* (2013.01)

(58) Field of Classification Search
CPC ..... B21D 7/02; B21D 7/021; B21D 7/022; B21D 7/024; B21D 7/08
See application file for complete search history.

(56) References Cited

U.S. PATENT DOCUMENTS

2015/0314353 A1* 11/2015 Massaro ..... B21D 7/02 72/159

* cited by examiner

*Primary Examiner* — Debra M Sullivan
(74) *Attorney, Agent, or Firm* — Mohr IP Law Solutions, PC

(57) ABSTRACT

Pressure die systems configured to be used in a tube bending machine having a machine frame. The pressure die systems include a system frame, a first pressure die, a second pressure die, and a pivot assembly. The first pressure die is supported on the system frame. The second pressure die is spaced from the first pressure die and supported on the system frame. The pivot assembly is moveably mounted to the system frame between the first pressure die and the second pressure die. The system frame pivots about the pivot assembly. The pivot assembly is configured to move relative to the system frame to different positions between the first pressure die and the second pressure die to define different pivot positions for the system frame.

20 Claims, 9 Drawing Sheets

PRESSURE DIE SYSTEMS FOR TUBE BENDING MACHINES

BACKGROUND

The present disclosure relates generally to pressure dies. In particular, pressure die systems for tube bending machines are described.

Tubes, pipes, and solid bars are common workpieces that are used for many different purposes. Tubes and pipes may be used to transfer fluids, either liquid or gas, from one location to another. Solid bars, tubes, and pipes (hereinafter simply tubes) can be used structurally as well, such as for conduit, roll cages, and handrails. Tubes come in a variety of shapes, including round, square, rectangular, and ovoid among others.

Bending tubes is useful for many different applications. Bending a tube is often necessary to process the tube into a specified shape for a given end product, such as a coil, a curved exhaust pipe, or a U-shaped conduit. Tube bending machines are generally used to bend tubes.

Pressure dies are sometimes used in tube bending machines to support tubes as the tube bending machine is bending the tube. A variety of pressure die types exist. However, conventional pressure dies are not entirely satisfactory for tube bending applications.

For example, existing pressure die systems do not enable bending tubes with sufficient bend quality. Conventional pressure die systems have undesirably high ovality and deformation measurements when challenging tube bending applications are undertaken. Existing pressure die systems result in deformity percentages of up to 10% or more, which is higher than ideal. In a 2.00" tube, a 10% deformity will result in the tube measuring 1.80" at the bend, which degrades the strength and aesthetics of the bent tube structure.

Another limitation of conventional pressure die systems is that they are insufficiently adjustable. Existing pressure die systems do not allow for precise adjustments of the pressure die pressure over a continuous range of pressures. Further, conventional pressure die systems do not enable users to precisely adjust the location of the pressure applied. The pressure exerted by a pressure die and the location where the pressure is exerted each has a significant effect on the accuracy and deformation of the bend. Conventional pressure die systems are also limited to symmetrical design features, which tends to reduce their accuracy as compared to asymmetrical design features.

Conventional pressure die systems are manufactured by expensive, limiting manufacturing techniques. For example, many conventional pressure die systems are milled or casted. Milled and casted pressure die systems tend to be expensive to produce and to have limited features.

A shortcoming of existing pressure die systems that include two pressure dies is that they fix the spacing between pressure dies. It would be desirable to have a pressure die system that enabled the spacing between two pressure dies to be selectively changed. It would be further desirable for a pressure die system to enable adjusting the location where pressure is applied.

Thus, there exists a need for pressure die systems that improve upon and advance the design of known pressure die systems. Examples of new and useful pressure die systems relevant to the needs existing in the field are discussed below.

SUMMARY

The present disclosure is directed to pressure die systems configured to be used in a tube bending machine having a machine frame. The pressure die systems include a system frame, a first pressure die, a second pressure die, and a pivot assembly. The first pressure die is supported on the system frame. The second pressure die is spaced from the first pressure die and supported on the system frame. The pivot assembly is moveably mounted to the system frame between the first pressure die and the second pressure die. The system frame pivots about the pivot assembly. The pivot assembly is configured to move relative to the system frame to different positions between the first pressure die and the second pressure die to define different pivot positions for the system frame.

DETAILED DESCRIPTION

Figure 1:
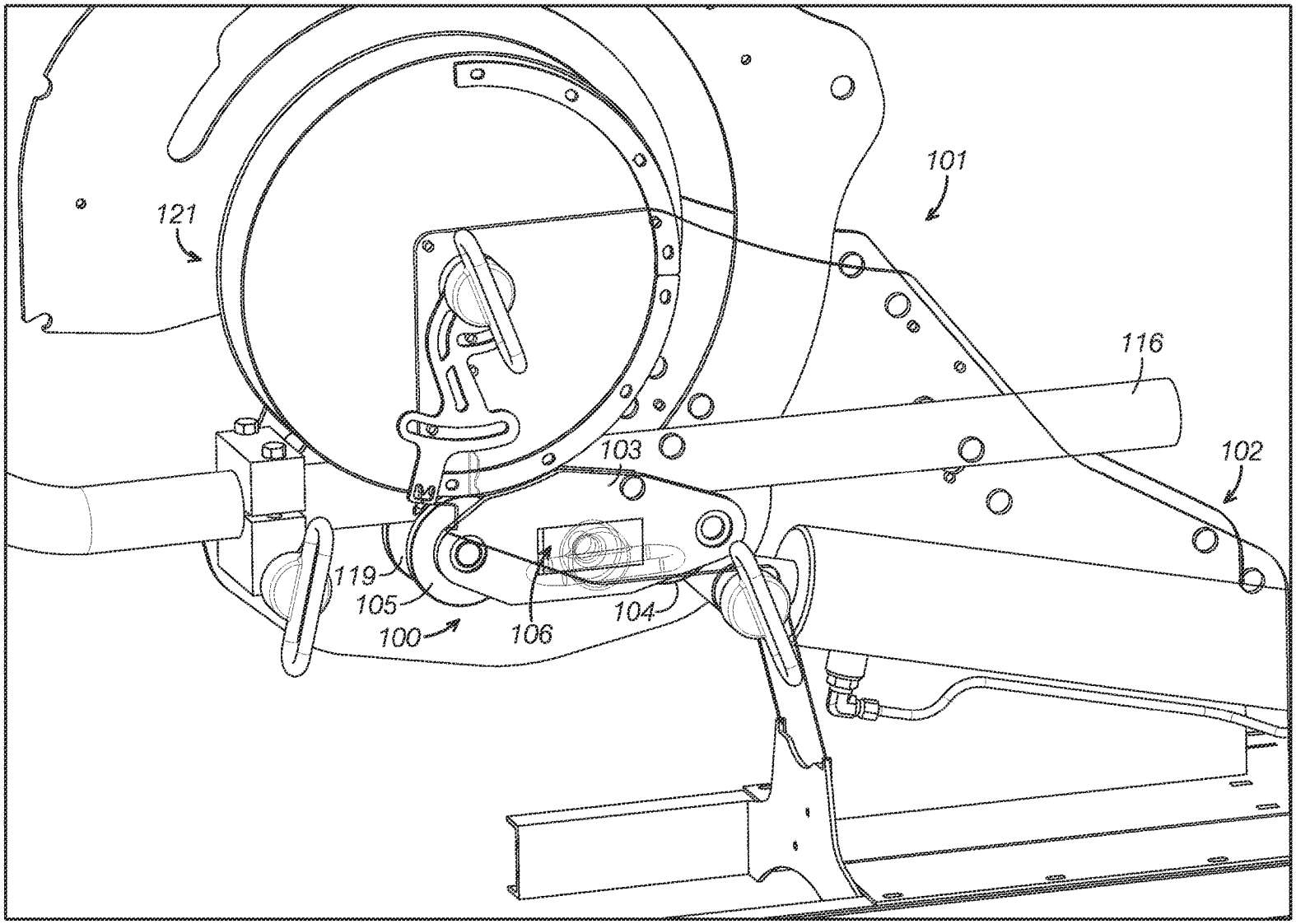
FIG. 1 is a side perspective view of a pressure die system for a tube bending machine.

The disclosed pressure die systems will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various pressure die systems are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

"Communicatively coupled" means that an electronic device exchanges information with another electronic device, either wirelessly or with a wire-based connector, whether directly or indirectly through a communication network.

"Controllably coupled" means that an electronic device controls operation of another electronic device.

Pressure Die Systems for Tube Bending Machines

With reference to the figures, pressure die systems for tube bending machines will now be described. The pressure die systems discussed herein function to support a tube while the tube is being bent by a tube bending machine.

The reader will appreciate from the figures and description below that the presently disclosed pressure die systems address many of the shortcomings of conventional pressure die systems.

For example, the novel pressure die systems below enable bending tubes with significantly increased accuracy as compared to conventional pressure die systems. With the novel pressure die systems descried herein, challenging tube bending applications result in less ovality and deformation.

Whereas existing pressure die systems result in deformity percentages of up to 10% or more, the novel pressure die systems described in this document reduce the deformity percentages to only approximately 6% in challenging applications and to approximately only 1% in less challenging applications. In a 2.00" tube, a 10% deformity will result in the tube measuring 1.80" at the bend and a 6% deformity will result in the tube measuring 1.88" at the bend. The significantly reduced deformity at the bend preserves the strength and improves the aesthetics of the bent tube structure.

The novel pressure die systems described herein are robustly adjustable. The novel pressure die systems allow for precise adjustments of the pressure exerted by the pressure dies over a continuous range. The precise adjustment of the pressure exerted by a novel pressure die systems described below has a significant effect on the accuracy and deformation of the bend. Advantageously, the novel pressure die systems described in this document enable the spacing between two pressure dies to be selectively changed.

Unlike conventional pressure die systems, the novel pressure die systems described in this document include asymmetrical design features. The asymmetrical design features improve the accuracy of bends. The asymmetrical design features included in the novel pressure die systems below include spacing from the center pivot to the pressure die axles and an offset of a bearing port in a bearing block relative to the center of a pivot assembly. The asymmetrical design allows greater range of adjustment.

The novel pressure die systems described herein are manufactured by modem manufacturing techniques. For example, the novel pressure die systems below may be manufactured by laser cutting and CNC turning as opposed to milling or casting. The modem manufacturing techniques enable enhanced capabilities in the finished system and are relatively inexpensive to produce.

Contextual Details

Ancillary features relevant to the pressure die systems described herein will first be described to provide context and to aid the discussion of the pressure die systems.

Tube Bending Machine

The pressure die systems described below are used in tube bending machines. Tube bending machines function to bend tubes, pipes, rods, and other elongate members. One example of a tube bending machine, tube bending machine 101, is depicted in FIGS. 1-3.

Figure 2:
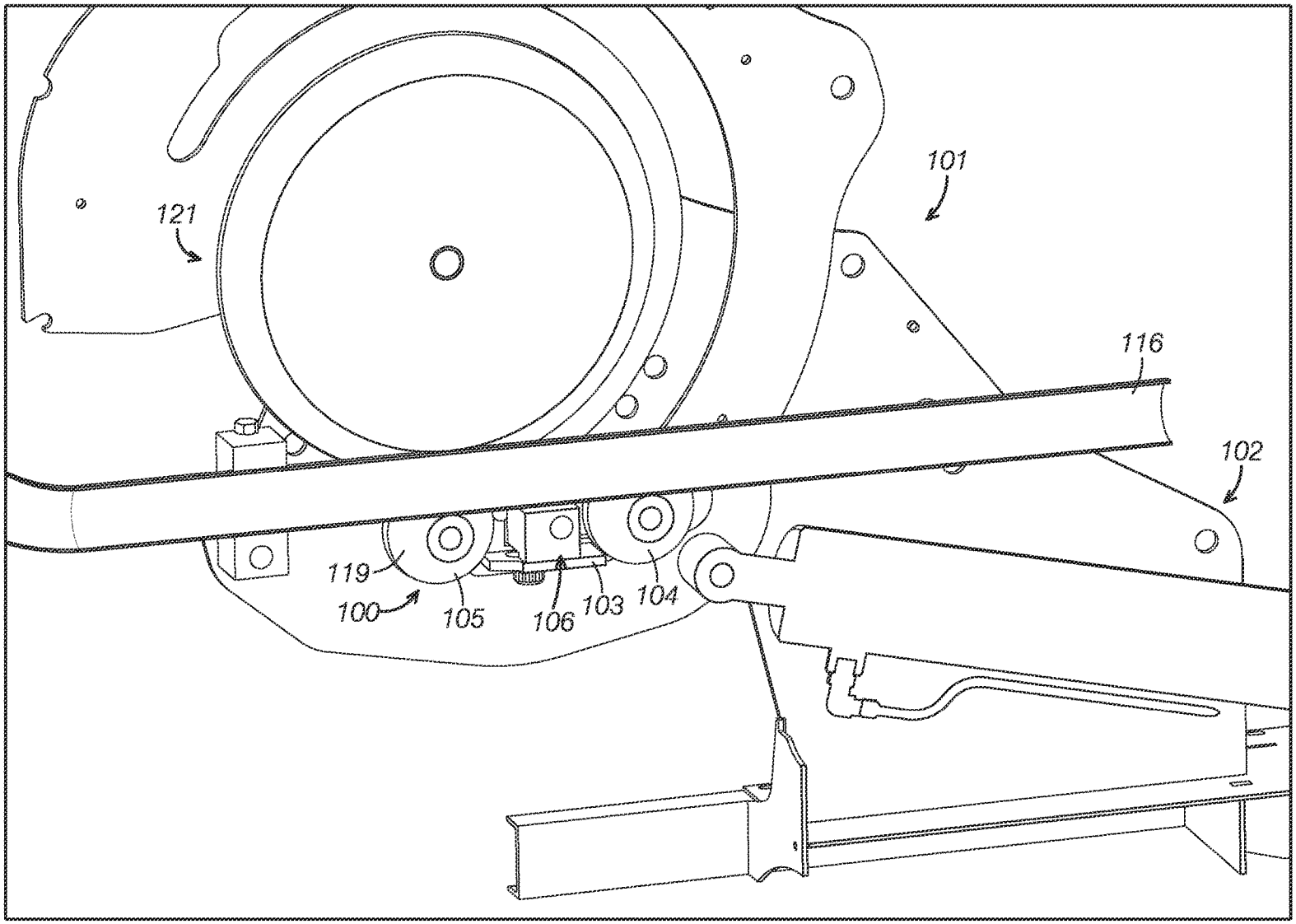
FIG. 2 is a longitudinal cross section view through the pressure die system and tube bending machine shown in FIG. 1 depicting first and second pressure dies supporting a tube.
Figure 3:
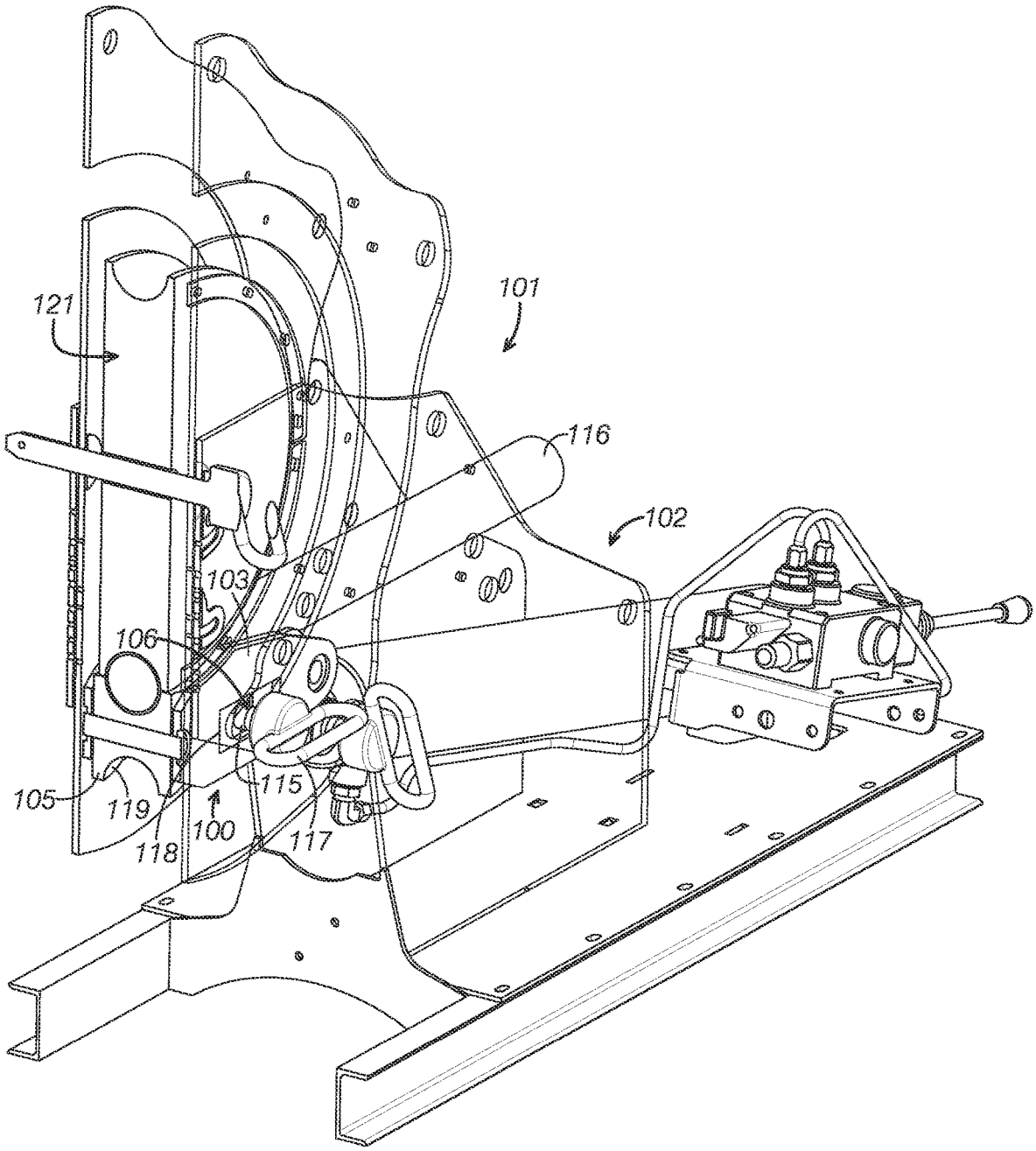
FIG. 3 is a lateral cross section view through the first pressure die shown in FIG. 1 depicting the second pressure die supporting a tube underneath a bending die.

As shown in FIGS. 1-3, tube bending machine 101 includes a bending die 121 supported on a machine frame 102. Tube bending machine 101 includes additional features as well, including an actuator and a clamp. In some examples, the tube bending machine in which the pressure die systems below are used include additional, alternative, or fewer features than depicted in FIGS. 1-3.

The tube bending machine may be any currently known or later developed type of tube bending machine. The reader will appreciate that a variety of tube bending machine types exist and could be used in place of the tube bending machine shown in the figures. In addition to the types of tube bending machines existing currently, it is contemplated that the pressure die systems described herein could incorporate new types of tube bending machines developed in the future.

The size and shape of the tube bending machine may be varied as needed for a given application. In some examples, the tube bending machine is larger relative to the other components than depicted in the figures. In other examples, the tube bending machine is smaller relative to the other components than depicted in the figures. Further, the reader should understand that the tube bending machine and the other components may all be larger or smaller than described herein while maintaining their relative proportions.

Bending Die

The reader can see in FIGS. 1-3 that bending die 121 is configured to bend tube 116 when tube 116 is forced against bending die 121. The bending die may be any currently known or later developed type of bending die. The reader will appreciate that a variety of bending die types exist and could be used in place of the bending die shown in the figures. In addition to the types of bending dies existing currently, it is contemplated that the pressure die systems described herein could incorporate new types of bending dies developed in the future.

The size and shape of the bending die may be varied as needed fora given application. In some examples, the bending die is larger relative to the other components than depicted in the figures. In other examples, the bending die is smaller relative to the other components than depicted in the figures. Further, the reader should understand that the bending die and the other components may all be larger or smaller than described herein while maintaining their relative proportions.

In the present example, the bending die is composed of metal. However, the bending die may be composed of any currently known or later developed material suitable for the applications described herein for which it is used. Suitable materials include metals, polymers, ceramics, wood, and composite materials.

Tube

The pressure die systems described below are used with tube bending machines to bend tubes. One example of a tube, a tube 116, is depicted in FIGS. 1-3.

As described below, tube 116 is bent to defined parameters by tube bending machine 101 in conjunction with pressure die system 100. The tube may be any currently known or later developed type of tube, pipe, or solid bar. The reader will appreciate that a variety of tube types exist and could be used in place of the tube shown in the figures. In addition to the types of tubes existing currently, it is contemplated that the tube bending systems described herein could incorporate new types of tubes developed in the future.

The size of the tube may be varied as needed for a given application. In some examples, the tube is larger relative to the other components than depicted in the figures. In other examples, the tube is smaller relative to the other components than depicted in the figures. Further, the reader should understand that the tube and the other components may all be larger or smaller than described herein while maintaining their relative proportions.

The tube may be any of a wide variety of currently known or later developed metals and effectively bent by the tube bending systems described below. Suitable tube materials include carbon steels (1010, 1020, 1026, and 4130 steel), stainless steels, aluminum (6061 and 6063 up to T6 temper), titanium in CWSR (cold worked stress relieved) and annealed condition (2.5AL-3V. CP2, others), as well as copper and its alloys.

Pressure Die System Embodiment One

With reference to FIGS. 1-9, a pressure die system 100 will now be described as a first example of a pressure die system. As depicted in FIGS. 1-3, pressure die system 100 is configured to be used in tube bending machine 101.

With reference to FIGS. 1-9, pressure die system 100 includes a system frame 103, a first pressure die 104, a second pressure die 105, and a pivot assembly 106. In other examples, the pressure die system includes fewer components than depicted in the figures. In certain examples, the pressure die system includes additional or alternative components than depicted in the figures.

The size and shape of the pressure die system may be varied as needed for a given application. In some examples, the pressure die system is larger relative to the other components than depicted in the figures. In other examples, the pressure die system is smaller relative to the other components than depicted in the figures. Further, the reader should understand that the pressure die system and the other components may all be larger or smaller than described herein while maintaining their relative proportions.

System Frame

Figure 4:
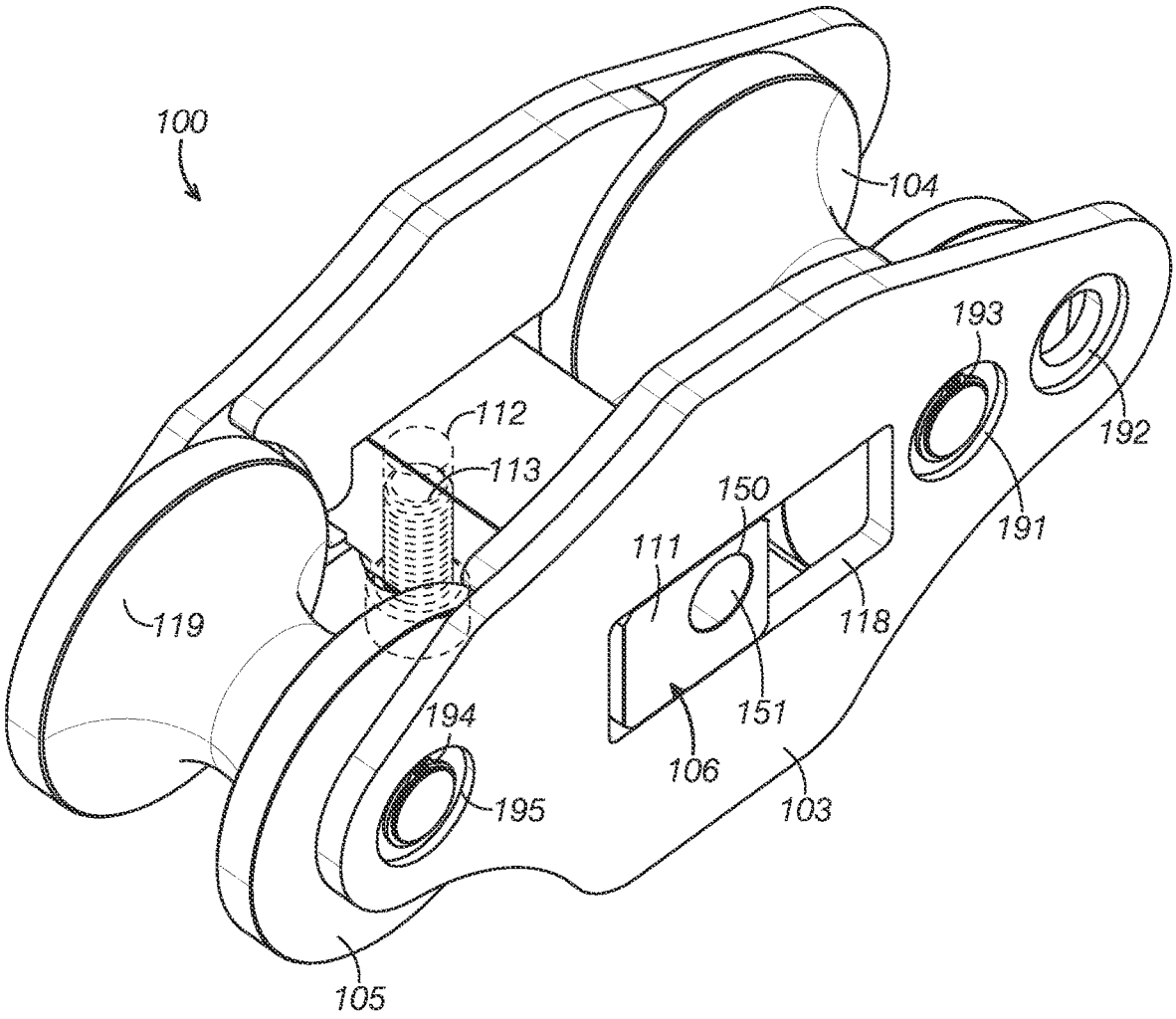
FIG. 4 is a perspective view of the pressure die system shown in FIG. 1.
Figure 5:
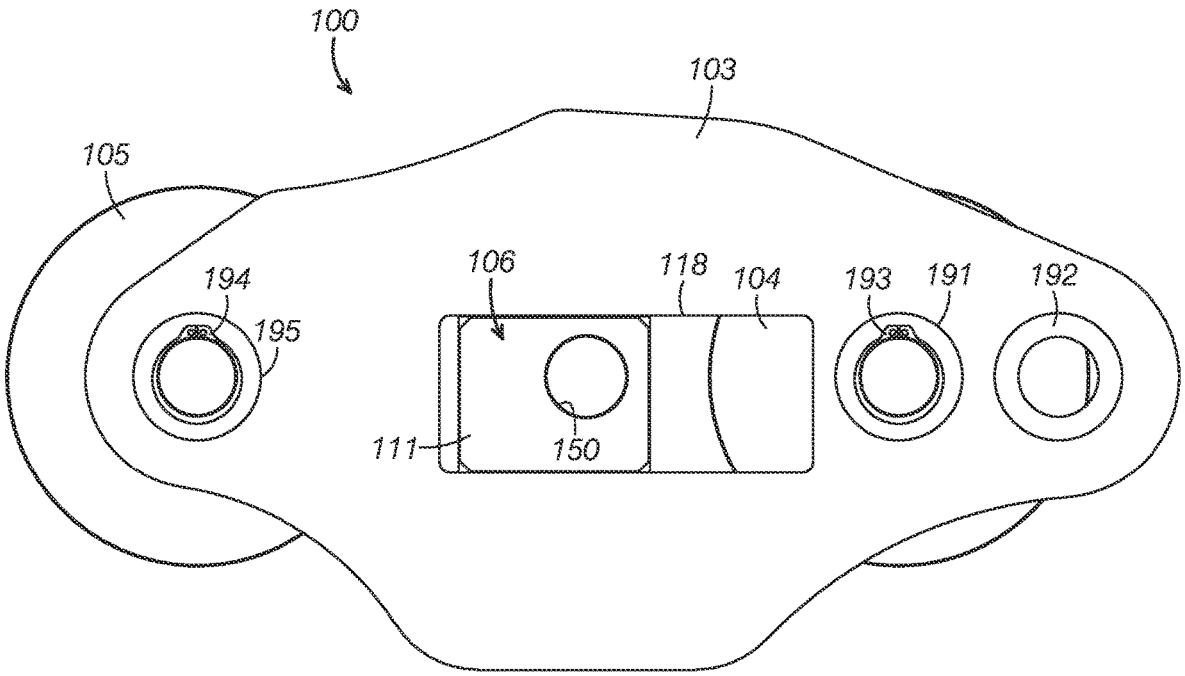
FIG. 5 is a left-side elevation view of the pressure die system shown in FIG. 1.
Figure 6:
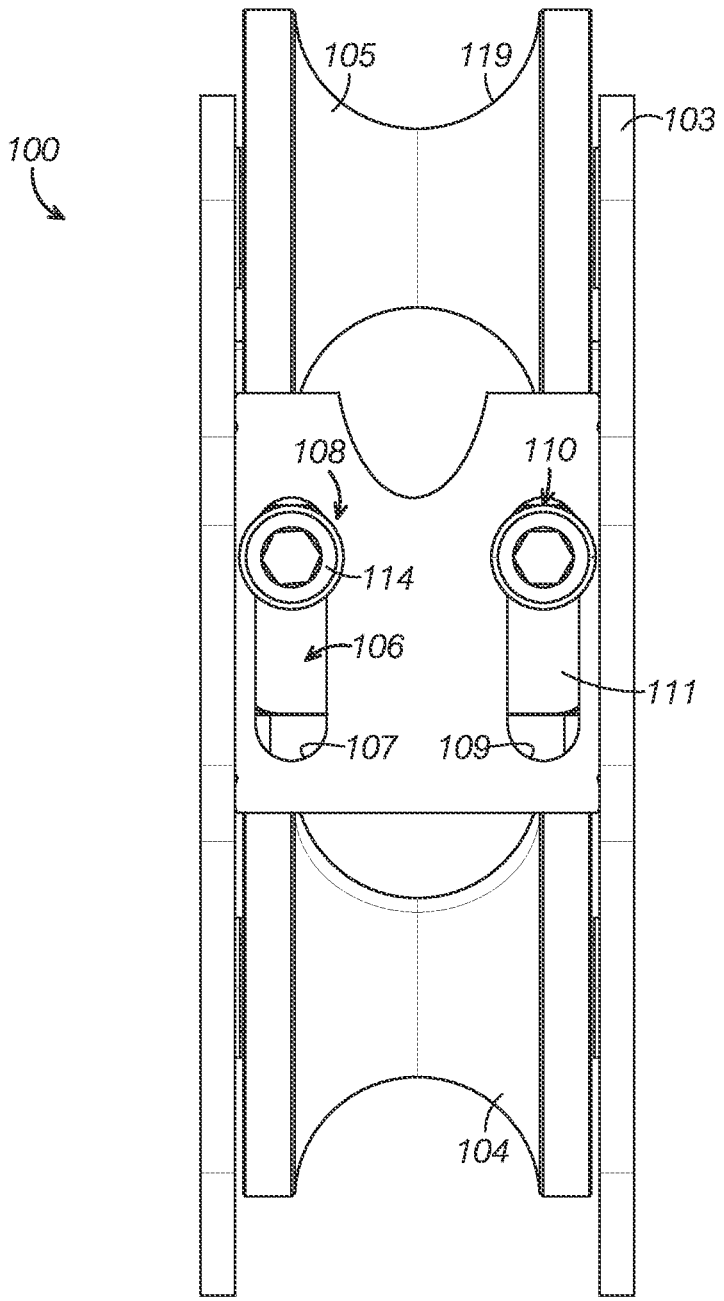
FIG. 6 is a bottom view of the pressure die system shown in FIG. 1.
Figure 7:
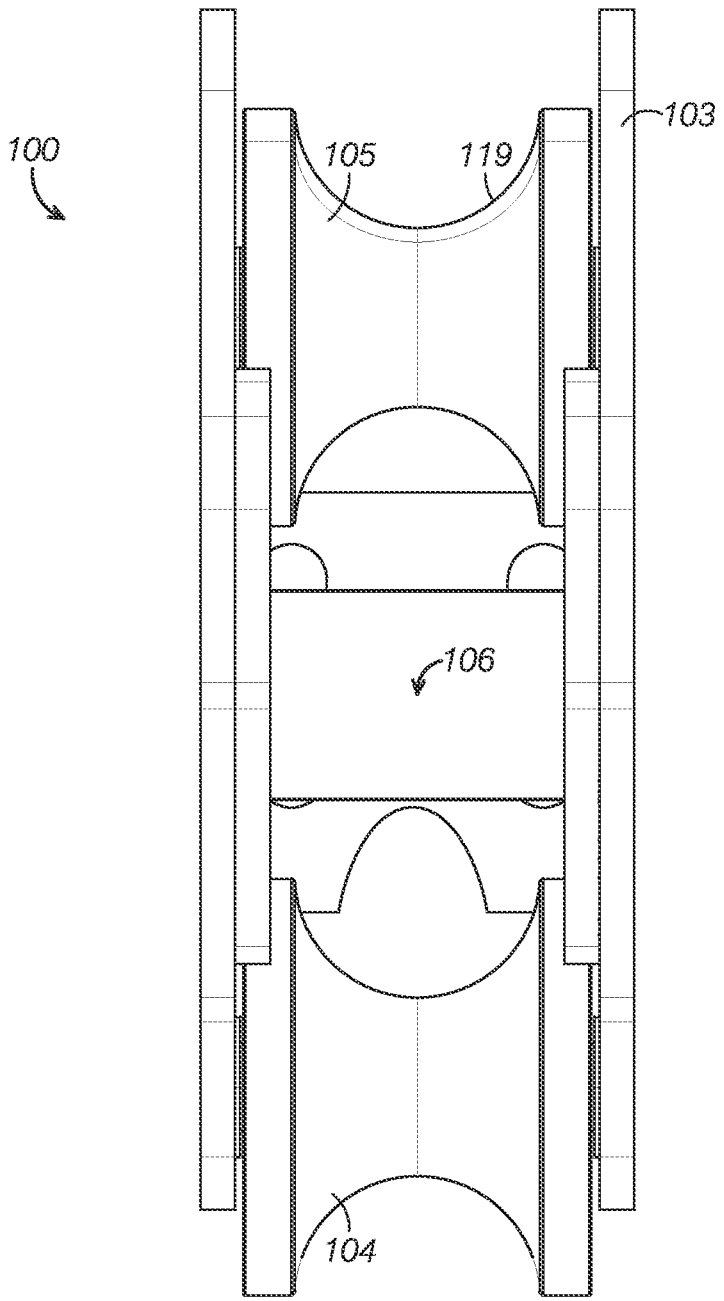
FIG. 7 is a top view of the pressure die system shown in FIG. 1.

System frame 103 functions to support the other components of pressure die system 100, including first pressure die 104 and second pressure die 105. As depicted in FIGS. 4-6, system frame 103 defines a first slot 107, a second slot 109, a window 118, an alpha port 191, a beta port 192, and a chi port 195.

The reader can see in FIGS. 1-3 that system frame 103 is supported by bearing block 111 and journal 115 of pivot assembly 106. As shown in FIGS. 1-9, system frame 103 pivots as bearing block 111 pivots around journal 115. Thus, system frame 103 pivots about journal 115 of pivot assembly 106.

First slot 107 and second slot 109 each extend longitudinally from a position proximate first pressure die 104 to a position proximate second pressure die 105. With reference to FIG. 6, second slot 109 is laterally spaced from first slot 107. As shown in FIG. 6, first slot 107 receives a first projection 108 of pivot assembly 106 and second slot 109 receives a second projection 110 of pivot assembly 106.

The reader can see in FIGS. 3-5 that window 118 is disposed on a different face of system frame 103 than first slot 107 and second slot 109. With further reference to FIGS. 3-5, window 118 extends longitudinally along system frame 103. As shown in FIG. 3, journal 115 of pivot assembly 106 passes through window 118.

Alpha port 191, beta port 192, and chi port 195 function to rotationally support first pressure die 104 and second pressure die 105. First pressure die 104 may be selectively mounted in either alpha port 191 or beta port 192. Second pressure die 105 is mounted in chi port 195. Alpha port 191 is closer than beta port 192 to chi port 195; thus, mounting first pressure die 104 in alpha port 191 will result in first pressure die 104 being closer to second pressure die 105 than when first pressure die 104 is mounted in beta port 192.

The size and shape of the system frame may be varied as needed for a given application. In some examples, the system frame is larger relative to the other components than depicted in the figures. In other examples, the system frame is smaller relative to the other components than depicted in the figures. Further, the reader should understand that the system frame and the other components may all be larger or smaller than described herein while maintaining their relative proportions.

In the present example, the system frame is composed of metal. However, the system frame may be composed of any currently known or later developed material suitable for the applications described herein for which it is used. Suitable materials include metals, polymers, ceramics, wood, and composite materials.

Pressure Dies

The roles of the pressure dies are to support tube 116 while it is being bent by bending die 121. The reader can see in FIGS. 1-3 that second pressure die 105 supports tube 116 from a side of tube 116 opposite bending die 121 when tube 116 is forced against bending die 121.

As depicted in FIGS. 3-8, first pressure die 104 and second pressure die 105 are supported on system frame 103 by rotationally mounting within alpha port 191 and chi port 195, respectively. First pressure die 104 is selectively retained in alpha port 191 with a first retention ring 193 and second pressure die 105 is selectively retained in chi port 195 with second retention ring 194. Optionally, first pressure die 104 may be rotationally mounted in beta port 192 and retained with first retention ring 193 to selectively change the spacing between first pressure die 104 and second pressure die 105.

With reference to FIGS. 3-7 and 9, second pressure die 105 is spaced from first pressure die 104. As discussed above, the spacing between first pressure die 104 and second pressure die 105 may be selectively adjusted by mounting first pressure die 104 in either alpha port 191 or beta port 192. As shown in FIGS. 1-3, second pressure die 105 is disposed proximate bending die 121.

As depicted in FIGS. 1-3, second pressure die 105 supports tube 116 by pressing upwards against tube 116. Second pressure die 105 presses upwards against tube 116 in response to a downward force on first pressure die 104. The downward force on first pressure die 104 pivots system frame 103 about journal 115 of pivot assembly 106. System frame 103 pivoting about journal 115 moves second pressure die 105 upwards as first pressure die moves downwards 104.

With reference to FIGS. 4-9, first pressure die 104 and second pressure die 105 are roller dies. As shown in FIGS. 1-9, first pressure die 104 and second pressure die 105 include a curved face complementarily configured with a round outer profile of tube 116 to receive and support the round outer profile of tube 116. A curved face 119 of second pressure die 105 is depicted in FIGS. 1-8. In some examples, the curved face of one or both of the pressure dies supporting the tube is a parabola, a multi-radius curve, an irregular profile, or a non-round profile. The alternative face profiles may be selected to compensate for deformation of the tube during the bending process.

The pressure dies may be any currently known or later developed type of pressure die. The reader will appreciate that a variety of pressure die types exist and could be used in place of the pressure dies shown in the figures. In addition to the types of pressure dies existing currently, it is contemplated that the pressure die systems described herein could incorporate new types of pressure dies developed in the future.

The size and shape of the pressure dies may be varied as needed for a given application. In some examples, the pressure dies are larger relative to the other components than depicted in the figures. In other examples, the pressure dies are smaller relative to the other components than depicted in the figures. Further, the reader should understand that the pressure dies and the other components may all be larger or smaller than described herein while maintaining their relative proportions.

In the present example, the pressure dies are composed of metal. However, the pressure dies may be composed of any currently known or later developed material suitable for the applications described herein for which they are used. Suitable materials include metals, polymers, ceramics, wood, and composite materials.

Pivot Assembly

Pivot assembly 106 functions to couple system frame 103 to machine frame 102 and to enable system frame 103 to pivot. In addition to enabling system frame 103 to pivot, pivot assembly 106 functions to selectively define different pivot positions for system frame 103.

As depicted in FIGS. 4-7, pivot assembly 106 is configured to move relative to system frame 103. In particular, pivot assembly 106 is configured to move relative to system frame 103 to different positions between first pressure die 104 and second pressure die 105. Pivot assembly 106 moving to different positions relative to system frame 103 defines different pivot positions for system frame 103.

Expressed another way, the reader can see in FIGS. 1-9 that pivot assembly 106 is moveably mounted to system frame 103 between first pressure die 104 and second pressure die 105. With reference to FIG. 6, pivot assembly 106 is configured to selectively secure to system frame 103 at a given pivot position between first pressure die 104 and second pressure die 105.

As shown in FIGS. 1-7, pivot assembly 106 includes a first projection 108, a second projection 110, a bearing block 111, a journal 115, and a handle 117. The components of pivot assembly 106 are described in the subsections below.

The pivot assembly may be any currently known or later developed type of pivot assembly. The reader will appreciate that a variety of pivot assembly types exist and could be used in place of the pivot assembly shown in the figures. In addition to the types of pivot assemblies existing currently, it is contemplated that the pressure die systems described herein could incorporate new types of pivot assemblies developed in the future.

The size and shape of the pivot assembly may be varied as needed for a given application. In some examples, the pivot assembly is larger relative to the other components than depicted in the figures. In other examples, the pivot assembly is smaller relative to the other components than depicted in the figures. Further, the reader should understand that the pivot assembly and the other components may all be larger or smaller than described herein while maintaining their relative proportions.

In the present example, the pivot assembly is composed of metal. However, the pivot assembly may be composed of any currently known or later developed material suitable for the applications described herein for which it is used. Suitable materials include metals, polymers, ceramics, wood, and composite materials.

Bearing Block

Bearing block 111 functions to assist with coupling pivot assembly 106 to system frame 103 and to provide a bearing surface 151 for rotating around journal 115. The reader can see in FIG. 4 that bearing block 111 defines a first recess 112, a second recess, and a bearing port 150.

First recess 112 and the second recess are complementarily configured with first projection 108 and second projection 110, respectively. First recess 112 and the second recess are threaded to threadingly couple with first projection 108 and second projection 110. In particular, as depicted in FIG. 4, first recess 112 is threaded complementarily with shaft 113 of first projection 108 and the second recess is threaded complementarily with a shaft of second projection 110.

Bearing port 150 extends through bearing block 111 and receives journal 115. As shown in FIG. 4, bearing port 150 defines a bearing surface 151 for rotating around journal 115. The reader can see in FIGS. 4 and 5 that bearing port 150 is disposed in an off-center position of bearing block 111 proximate a right edge of system frame 103 resulting in an asymmetrical configuration.

Bearing block 111 is configured to be flipped and supported within system frame 103 in an alternate orientation. The alternate orientation of bearing block 111 positions bearing port 150 in an opposite asymmetrical configuration than depicted in FIGS. 4 and 5 for more adjustment capabilities. With system frame 103 maintaining its orientation depicted in FIGS. 4 and 5, in the alternate orientation of bearing block 111, bearing port 150 would be disposed off-center of bearing block 111 proximate the left edge of system frame 103 rather than off-center of bearing block 111 proximate the right edge of system frame 103.

The size and shape of the bearing block may be varied as needed for a given application. In some examples, the bearing block is larger relative to the other components than depicted in the figures. In other examples, the bearing block is smaller relative to the other components than depicted in the figures. Further, the reader should understand that the bearing block and the other components may all be larger or smaller than described herein while maintaining their relative proportions.

In the present example, the bearing block is composed of metal. However, the bearing block may be composed of any currently known or later developed material suitable for the applications described herein for which it is used. Suitable materials include metals, polymers, ceramics, wood, and composite materials.

Journal

Journal 115 functions to couple to machine frame 102 and to provide a rotation surface over which bearing block 111 may rotate. The reader can see in FIG. 3 that journal 115 extends from machine frame 103 through bearing port 150 out through window 118 to handle 117. With reference to FIG. 3, journal 115 is supported within bearing port 150 of bearing block 111. Bearing block 111 rotates around journal 115.

The size and shape of the journal may be varied as needed for a given application. In some examples, the journal is larger relative to the other components than depicted in the figures. In other examples, the journal is smaller relative to the other components than depicted in the figures. Further, the reader should understand that the journal and the other components may all be larger or smaller than described herein while maintaining their relative proportions.

Projections

The projections function to selectively couple bearing block 111 to system frame 103. The reader can see in FIGS. 4 and 6 that first projection 108 includes a shaft 113 and a head 114. As shown in FIG. 4, shaft 113 is threaded. The reader can see in FIGS. 4 and 6 that head 114 is disposed on shaft 113. Second projection 110 is configured the same as first projection 108. As shown in FIGS. 4, 6, 8, and 9, first projection 108 and second projection 110 are both bolts in the present example.

As shown in FIG. 6, first projection 108 extends through first slot 107 of system frame 103 and second projection 110 extends through second slot 109 of system frame 103. As shown in FIGS. 4-7, first projection 108 is partially disposed in first recess 112 to couple to bearing block 111. Second projection 110 operates in the same manner as first projection 108, so this discussion will focus on first projection 108 exclusively to avoid redundancy.

Figure 8:
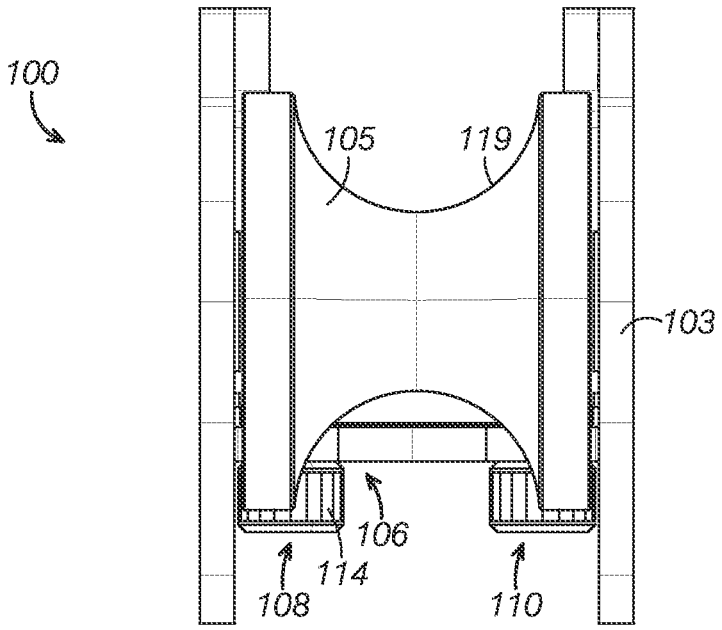
FIG. 8 is a front elevation view of the pressure die system shown in FIG. 1.
Figure 9:
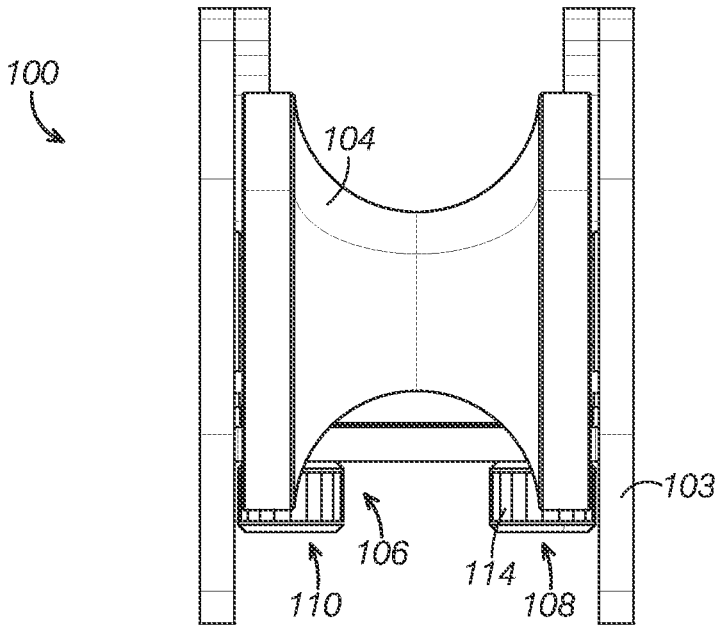
FIG. 9 is a rear elevation view of the pressure die system shown in FIG. 1.

With reference to FIGS. 6, 8, and 9, shaft 113 extends beyond system frame 103 through first slot 107. As depicted in FIGS. 6, 8, and 9, head 114 is disposed on an opposite side of system frame 103 than bearing block 111.

As depicted in FIG. 4, rotating first projection 108 in a first direction retracts shaft 113 further into first recess 112 and moves head 114 into a position abutting system frame 103. Head 114 abutting system frame 103 causes bearing block 111 to frictionally engage system frame 103. Bearing block 111 frictionally engaging system frame 103 secures pivot assembly 106 in a given position, which defines a given pivot position.

With reference to FIG. 4, rotating first projection 108 in a second direction opposite the first direction extends shaft 113 out of first recess 112 and moves head 114 away from system frame 103. Moving head 114 away from system frame 103 enables bearing block 111 to move relative to system frame 103.

The projections may be any currently known or later developed type of projection. The reader will appreciate that a variety of projection types exist and could be used in place of the projections shown in the figures. In addition to the types of projections existing currently, it is contemplated that the pressure die systems described herein could incorporate new types of projections developed in the future.

The number of projections in the pressure die system may be selected to meet the needs of a given application. The reader should appreciate that the number of projections may be different in other examples than is shown in the figures. For instance, some pressure die system examples include additional or fewer projections than described in the present example.

The size and shape of the projections may be varied as needed for a given application. In some examples, the projections are larger relative to the other components than depicted in the figures. In other examples, the projections are smaller relative to the other components than depicted in the figures. Further, the reader should understand that the projections and the other components may all be larger or smaller than described herein while maintaining their relative proportions.

Handle

Handle 117 functions to assist with selectively removing journal 115 from bearing port 150 and with selectively decoupling journal 115 from machine frame 102. As shown in FIG. 3, handle 117 is coupled to journal 115. The reader can see in FIG. 3 that journal 115 extends from machine frame 103 through bearing port 150 out through window 118 to handle 117.

The handle may be any currently known or later developed type of handle. The reader will appreciate that a variety of handle types exist and could be used in place of the handle shown in the figures. In addition to the types of handles existing currently, it is contemplated that the pressure die systems described herein could incorporate new types of handles developed in the future.

The size and shape of the handle may be varied as needed for a given application. In some examples, the handle is larger relative to the other components than depicted in the figures. In other examples, the handle is smaller relative to the other components than depicted in the figures. Further, the reader should understand that the handle and the other components may all be larger or smaller than described herein while maintaining their relative proportions.

In the present example, the handle is composed of plastic. However, the handle may be composed of any currently known or later developed material suitable for the applications described herein for which it is used. Suitable materials include metals, polymers, ceramics, wood, and composite materials.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A pressure die system for a tube bending machine, comprising:

a system frame;

a first pressure die supported on the system frame;

a second pressure die spaced from the first pressure die and supported on the system frame; and a pivot assembly configured to mount to the tube bending machine and moveably mounted to the system frame between the first pressure die and the second pressure die;

wherein the system frame pivots about the pivot assembly;

wherein the pivot assembly is configured to move relative to the system frame to different continuous positions between the first pressure die and the second pressure die to define different pivot positions for the system frame;

wherein the pivot assembly is configured to selectively and fixedly couple to the system frame to define a fixed pivot position for the system frame.

2. The pressure die system of claim 1, wherein the pivot assembly is configured to selectively secure to the system frame at a given pivot position between the first pressure die and the second pressure die.

3. The pressure die system of claim 2, wherein:

the system frame defines a first slot longitudinally extending from a position proximate the first pressure die to a position proximate the second pressure die;

the pivot assembly includes a first projection extending through the first slot.

4. The pressure die system of claim 3, wherein:

the system frame defines a second slot laterally spaced from the first slot and longitudinally extending from a position proximate the first pressure die to a position proximate the second pressure die; and the pivot assembly includes a second projection extending through the second slot.

5. The pressure die system of claim 3, wherein:

the pivot assembly includes a bearing block;

the bearing block defines a first recess; and the first projection is partially disposed in the first recess to couple to the bearing block.

6. The pressure die system of claim 5, wherein the first projection includes:

a shaft; and a head disposed on the shaft.

7. The pressure die system of claim 6, wherein:

the shaft extends beyond the system frame through the first slot; and the head is disposed on an opposite side of the system frame than the bearing block.

8. The pressure die system of claim 7, wherein:

the shaft is threaded; and the first recess is threaded complementarily with the shaft.

9. The pressure die system of claim 8, wherein rotating the first projection in a first direction retracts the shaft further into the first recess and moves the head into a position abutting the system frame to cause the bearing block to frictionally engage the system frame to secure the pivot assembly in the given pivot position.

10. The pressure die system of claim 9, wherein rotating the first projection in a second direction opposite the first direction extends the shaft out of the first recess and moves the head away from the system frame to enable the bearing block to move relative to the system frame.

11. The pressure die system of claim 6, wherein the first projection is a bolt.

12. The pressure die system of claim 1, wherein the pivot assembly includes:

a bearing block defining a bearing port; and a journal supported within the bearing port of the bearing block around which the bearing block may rotate.

13. The pressure die system of claim 12, wherein the system frame pivots about the journal.

14. The pressure die system of claim 1, wherein:

the second pressure die is disposed proximate a bending die of the tube bending machine that bends a tube when the tube is forced against the bending die.

15. The pressure die system of claim 14, wherein the second pressure die supports the tube from a side of the tube opposite the bending die when the tube is forced against the bending die.

16. The pressure die system of claim 15, wherein the second pressure die supports the tube by pressing upwards against the tube in response to a downward force on the first pressure die pivoting the pivot assembly and moving the second pressure die upwards.

17. The pressure die system of claim 12, wherein the pivot assembly includes a handle coupled to the journal.

18. The pressure die system of claim 17, wherein:

the system frame defines a window extending longitudinally along the system frame; and the journal extends through the window.

19. The pressure die system of claim 1, wherein the second pressure die is a roller die.

20. The pressure die system of claim 1, wherein the second pressure die includes a curved face complementarily configured with a round tube to receive and support an outside of the round tube.

* * * * *